US009388988B2

(12) United States Patent
Moehrle et al.

(10) Patent No.: US 9,388,988 B2
(45) Date of Patent: Jul. 12, 2016

(54) GAS TURBINE COMBUSTION CAP ASSEMBLY

(75) Inventors: Frank Moehrle, Palm City, FL (US); Luis Estrada, San German, PR (US); Jeremy Lefler, Stuart, FL (US); Martin Konen, Palm Beach Gardens, FL (US)

(73) Assignee: Siemens Energy, Inc., Orlando, FL (US)

( * ) Notice: Subject to any disclaimer, the term of this patent is extended or adjusted under 35 U.S.C. 154(b) by 1232 days.

(21) Appl. No.: 13/238,327

(22) Filed: Sep. 21, 2011

(65) Prior Publication Data

US 2012/0291440 A1 Nov. 22, 2012

Related U.S. Application Data

(60) Provisional application No. 61/488,199, filed on May 20, 2011.

(51) Int. Cl.

| | |
|---|---|
| ***F23R 3/28*** | (2006.01) |
| ***F23R 3/32*** | (2006.01) |
| ***F23D 14/10*** | (2006.01) |
| ***F23R 3/60*** | (2006.01) |

(52) U.S. Cl.

CPC . *F23R 3/60* (2013.01); *F23R 3/283* (2013.01); *F23R 3/286* (2013.01); *F23D 14/105* (2013.01); *F23R 3/32* (2013.01)

(58) Field of Classification Search

CPC ..... F23R 3/283; F23R 3/286; F23D 14/08; F23D 14/10; F23D 14/105

USPC ..... 60/39.37, 734, 737–744

See application file for complete search history.

(56) References Cited

U.S. PATENT DOCUMENTS

| | | | | |
|---|---|---|---|---|
| 3,055,179 | A * | 9/1962 | Lefebvre et al. | 60/737 |
| 4,387,559 | A * | 6/1983 | Leto | 60/800 |
| 5,259,184 | A * | 11/1993 | Borkowicz et al. | 60/39.55 |
| 5,274,991 | A * | 1/1994 | Fitts | 60/800 |
| 5,309,709 | A * | 5/1994 | Cederwall et al. | 60/39.23 |
| 5,365,738 | A * | 11/1994 | Etheridge | 60/742 |
| 5,722,230 | A * | 3/1998 | Cohen et al. | 60/39.37 |
| 5,729,968 | A * | 3/1998 | Cohen et al. | 60/39.6 |
| 5,873,237 | A * | 2/1999 | Medla et al. | 60/800 |
| 5,924,275 | A * | 7/1999 | Cohen et al. | 60/778 |
| 6,374,594 | B1 * | 4/2002 | Kraft et al. | 60/39.37 |
| 6,438,959 | B1 * | 8/2002 | Dean et al. | 60/760 |
| 6,923,002 | B2 * | 8/2005 | Crawley et al. | 60/772 |
| 6,951,109 | B2 * | 10/2005 | Lemon et al. | 60/760 |
| 6,968,693 | B2 * | 11/2005 | Colibaba-Evulet et al. | 60/748 |
| 2002/0083711 | A1 * | 7/2002 | Dean et al. | 60/737 |
| 2003/0217556 | A1 * | 11/2003 | Wiebe | 60/796 |
| 2005/0223713 | A1 * | 10/2005 | Ziminsky et al. | 60/776 |
| 2005/0268617 | A1 * | 12/2005 | Amond et al. | 60/776 |
| 2006/0230763 | A1 * | 10/2006 | Johnson et al. | 60/740 |

(Continued)

*Primary Examiner* — Phutthiwat Wongwian
*Assistant Examiner* — Rene Ford

(57) ABSTRACT

A gas turbine combustor cap assembly (24) including a pre-mix tube (42, 44) with an upstream flange (60, 62) that aligns and seats the tube against a primary feed plate (66) attached to an upstream end of a support ring (48). The pre-mix tube may have an intermediate flange (64) at an intermediate position on the length of the tube that aligns and seats the tube against an intermediate structural frame (68) attached to the support ring at an intermediate position on the length of the support ring. The combustor cap assembly (24) may have multiple pre-mix tubes, including a central pre-mix tube (44) with upstream (62) and intermediate (64) flanges and a circular array of outer pre-mix tubes (44) with at least an upstream flange (64).

16 Claims, 5 Drawing Sheets

(56) References Cited

U.S. PATENT DOCUMENTS

| | | | | |
|---|---|---|---|---|
| 2008/0016874 | A1* | 1/2008 | Markarian et al. | 60/772 |
| 2008/0155987 | A1* | 7/2008 | Amond et al. | 60/737 |
| 2009/0188255 | A1* | 7/2009 | Green et al. | 60/737 |
| 2009/0223225 | A1* | 9/2009 | Kraemer et al. | 60/723 |
| 2009/0293489 | A1* | 12/2009 | Tuthill et al. | 60/752 |
| 2010/0050640 | A1* | 3/2010 | Belsom et al. | 60/734 |
| 2011/0049112 | A1* | 3/2011 | Johnson et al. | 219/121.64 |

* cited by examiner

GAS TURBINE COMBUSTION CAP ASSEMBLY

This application claims benefit of the 20 May 2011 filing date of U.S. patent application Ser. No. 61/488,199, which is incorporated by reference herein.

FIELD OF THE INVENTION

This invention relates to structural aspects of fuel/air pre-mix tubes in a gas turbine combustor cap assembly.

BACKGROUND OF THE INVENTION

An industrial gas turbine engine combustion system may include several individual combustion device assemblies, for example as described in U.S. Pat. No. 5,274,991. These combustion device assemblies contain a fuel and oxidizer supply that may be composed of a single or multiple set of fuel and oxidizer injector mixing cavities. These cavities are referred to as pre-mix tubes. The primary purpose of the pre-mix tube is to supply a precisely metered and mixed fuel and oxidizer ratio for combustion. The pre-mixed tubes are often supported in a cantilevered fashion from a primary feed structure, and pass through a relatively flexible screen known as an effusion plate. Pre-mix tubes have been known to liberate at the weld joint and cause significant downstream turbine damage.

SUMMARY OF THE INVENTION

Embodiments of the present pre-mix tube may incorporate a geometric feature that reduces weld stress and allows for additional weld locations without adversely affecting the pre-mix tube shape or function.

BRIEF DESCRIPTION OF THE DRAWINGS

The invention is explained in the following description in view of the drawings that show.

DETAILED DESCRIPTION OF THE INVENTION

Figure 1:
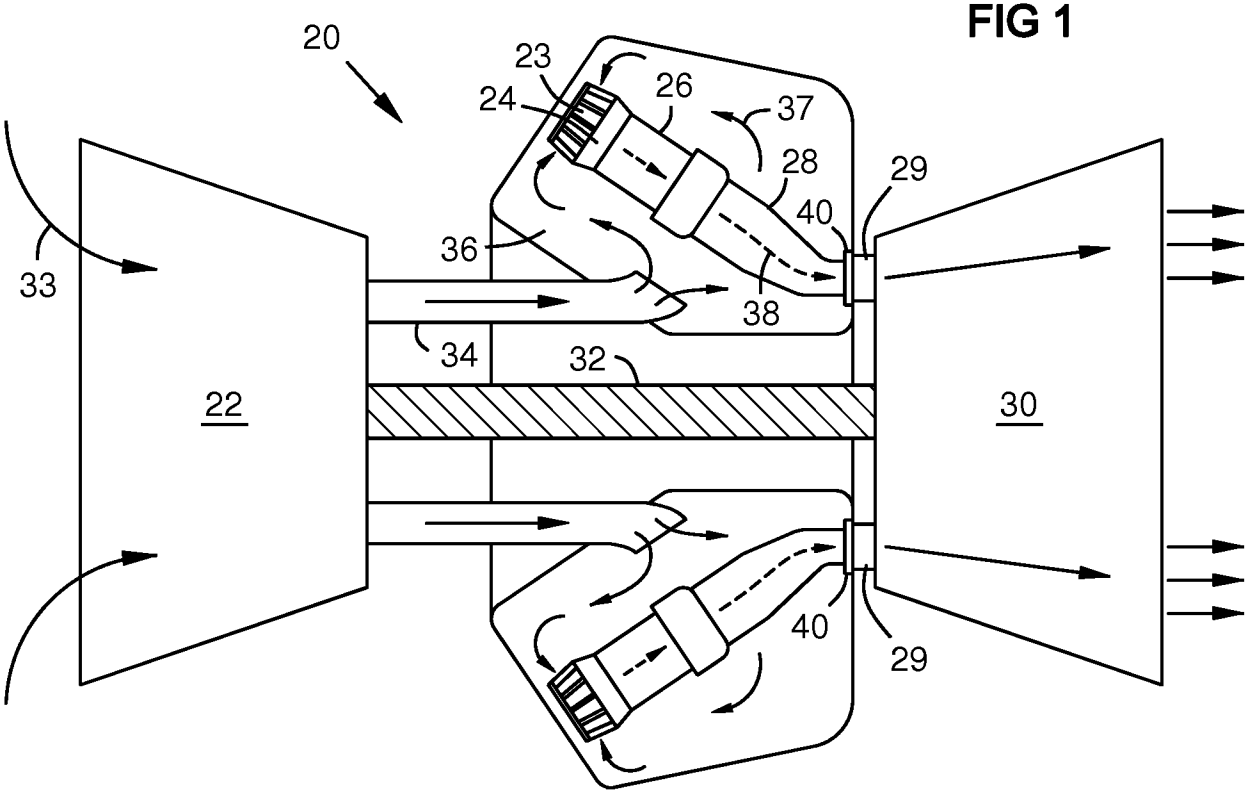
FIG. 1 is a schematic view of an exemplary gas turbine engine within which embodiments of the invention may reside.

FIG. 1 is a schematic view of an exemplary gas turbine engine 20 that includes a compressor 22, fuel injector assemblies also known as combustor cap assemblies 24, combustion chambers 26, transition ducts 28, a turbine section 30 and an engine shaft 32 by which the turbine 30 drives the compressor 22. Several combustor assemblies 24, 26, 28 may be arranged in a circular array in a can-annular design. In an exemplary embodiment, combustor assemblies 24, 26, 28 arranged in a can-annular design are reverse flow combustor assemblies as recognized by those skilled in the art but embodiments of the invention may be adapted for various types of combustor assemblies. During operation, the compressor 22 intakes air 33 and provides a flow of compressed air 37 to the combustor inlets 23 via a diffuser 34 and a combustor plenum 36. This compressed air 37 also serves as coolant for the combustion chambers 26 and transition ducts 28. The fuel injectors (not shown) within assembly 24 mix fuel with the compressed air. This mixture burns in the combustion chamber 26 producing hot combustion gas 38, also called the working gas, that passes through the transition duct 28 to the turbine 30 via a sealed connection between an exit frame 40 of the transition duct and a turbine inlet 29. The diffuser 34 and the plenum 36 may extend annularly about the engine shaft 32. The compressed airflow 37 in the combustor plenum 36 has higher pressure than the working gas 38 in the combustion chamber 26 and in the transition duct 28.

Figure 2:
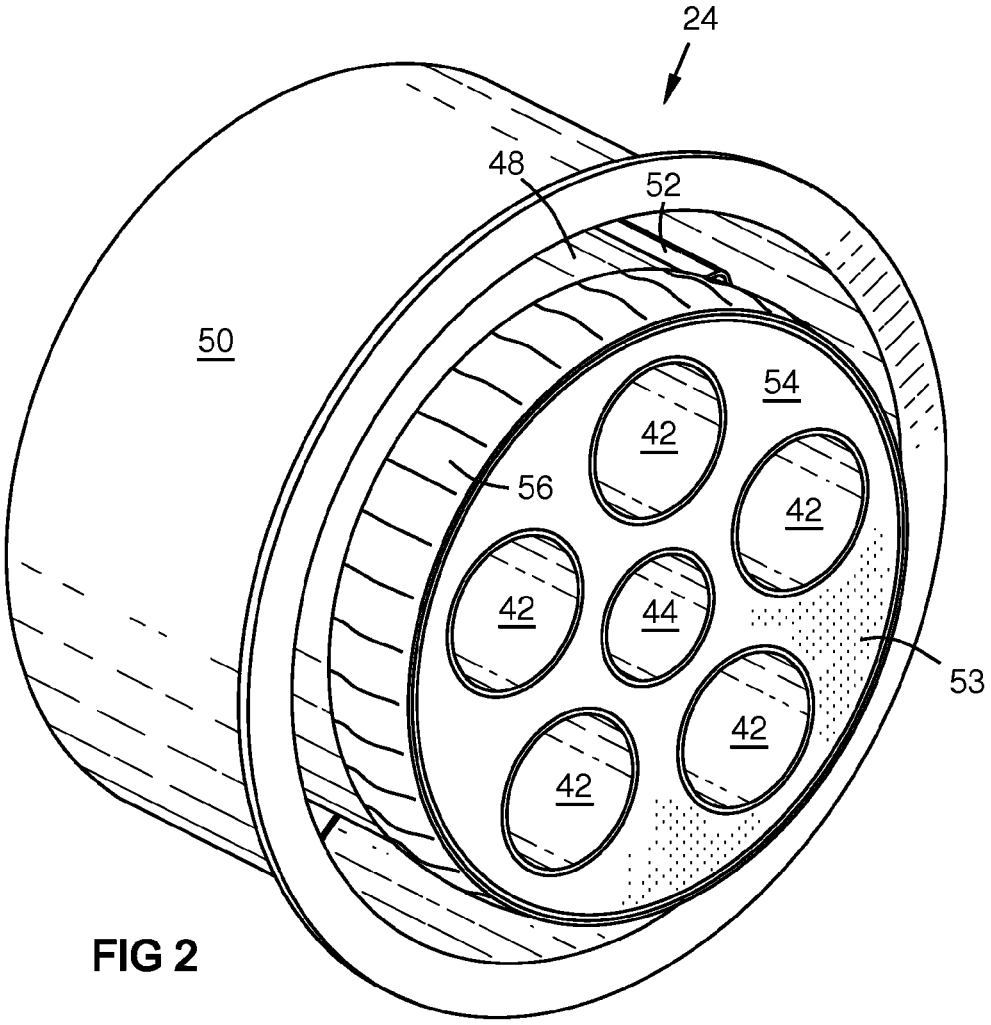
FIG. 2 is a perspective view of the downstream end of an exemplary combustor cap assembly within which embodiments of the invention may reside.

FIG. 2 is a perspective view of the downstream end of an exemplary fuel injector or combustor cap assembly 24 with a circular array of outer fuel/air pre-mix tubes 42 surrounding a central pre-mix tube 44. When fully assembled, fuel injectors (not shown) are mounted in these tubes. The cap assembly 24 may have a main support structure that may include inner and outer support rings 48, 50 interconnected by brackets 52. The downstream end of the inner support ring 48 may be enclosed by an effusion plate 54, which surrounds but does not enclose the downstream ends of the tubes 42, 44. The effusion plate 54 may include a plurality of perforations 53 for effusion cooling by compressed air inside the inner ring 48 that bleeds through the perforations into the combustion chamber 26. An annular spring seal 56 may surround the downstream end of the inner support ring 48 for connecting the combustion chamber 26 liner to the inner support ring 48.

Figure 3:
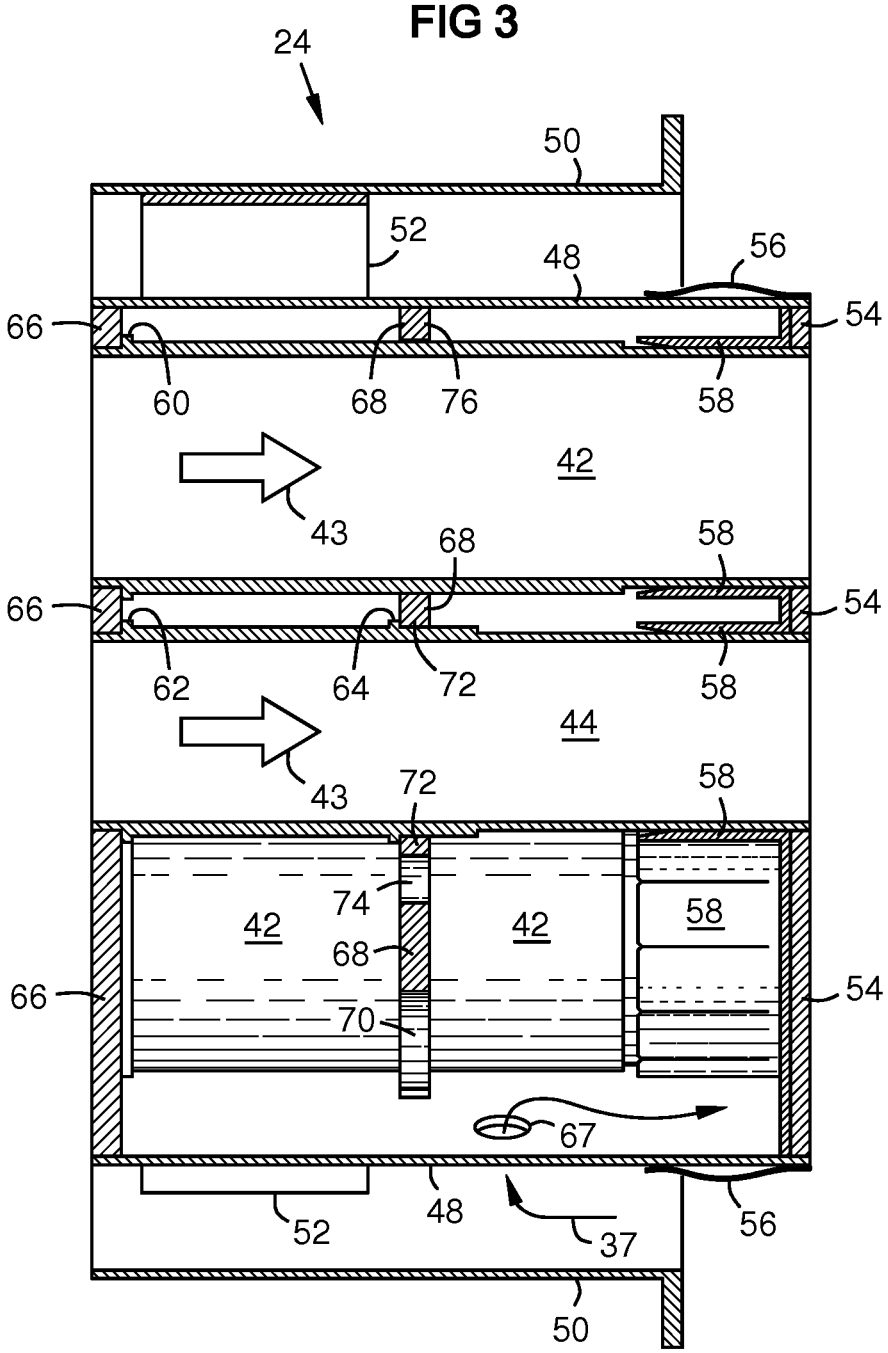
FIG. 3 is a sectional side view of the combustor cap assembly of FIG. 2 containing an exemplary embodiment of the invention.

FIG. 3 is a sectional side view of a combustor cap assembly 24 that may include a circular array of exemplary outer fuel/air pre-mix tubes 42 surrounding an exemplary central pre-mix tube 44 in accordance with aspects of the invention. The flow direction 43 of fuel and combustion air is indicated to orient what is meant by "upstream" or forward and "downstream" or aft herein. When fully assembled, fuel injectors (not shown) are mounted in the pre-mix tubes 42, 44. Each pre-mix tube 42, 44 may be used to individually isolate a fuel injection source allowing tuned mixing of fuel and oxidizer. The downstream end of each pre-mix tube 42, 44 may slide into a spring seal 58 attached to the effusion plate 54. The upstream end of each pre-mix tube 42, 44 may be fixedly attached to a primary feed plate 66, for example, by welding around a seating and alignment flange 60, 62. The primary feed plate 66 may be attached across the upstream end of the inner support ring 48. Coolant inlet holes 67 may be provided in the inner support ring 48 for compressed air 37 that will pass through perforations in the effusion plate 54.

The inventors of the present invention have determined that certain pre-mix tubes were retained within combustor cap assemblies without an alignment and seating feature, without which, excessive combustion system dynamic excitation can result in pre-mix tube liberation and consequential downstream combustion system and turbine damage. Embodiments of the present fuel pre-mix tube design increase retention through one or more alignment flanges and/or seating features 60, 62, 64 to improve overall combustion system durability. These features improve pre-mix tube alignment with the fuel source, and reduce excessive weld stress from dynamic excitation. This improves combustion system strength margins and self-induced combustion system dynamic capability. One will appreciate that aspect of this invention may be included in newly manufactured equipment as well as retrofitted into existing gas turbine engines.

The upstream end of each exemplary pre-mix tube 42, 44 may have an upstream alignment flange 60, 62 that retains and aligns the respective pre-mix tube against the primary feed plate 66. A portion of the respective tube 42, 44 may extend into or through the primary feed plate 66 (as illustrated), or the tube may end at the flange 60,62 with the flange 60,62 being aligned otherwise to its location on the plate 66 In addition, the central pre-mix tube 44 and/or other pre-mix tubes 42 may have an intermediate alignment flange 64 at a position intermediate the tube length that aligns and retains the tube against an intermediate structural frame 68. The central tube 44, or each tube 42, 44, may be attached to the intermediate structural frame 68, for example by welding around the intermediate flange 64.

In the illustrated embodiment, the central pre-mix tube 44 is received within a hole in the intermediate structural frame 68, and has an intermediate alignment flange 64 that seats against a surrounding portion 72 of the intermediate structural frame 68. The outer pre-mix tubes 42 are not necessarily fixed to the intermediate structural frame 68, but may alternatively be slidably engaged in respective outer stabilization rings 70 or holes formed in surrounding portions of the intermediate structural frame 68. This slidable engagement limits the relative lateral movement of the outer tubes 42 while allowing differential thermal expansion.

Figure 4:
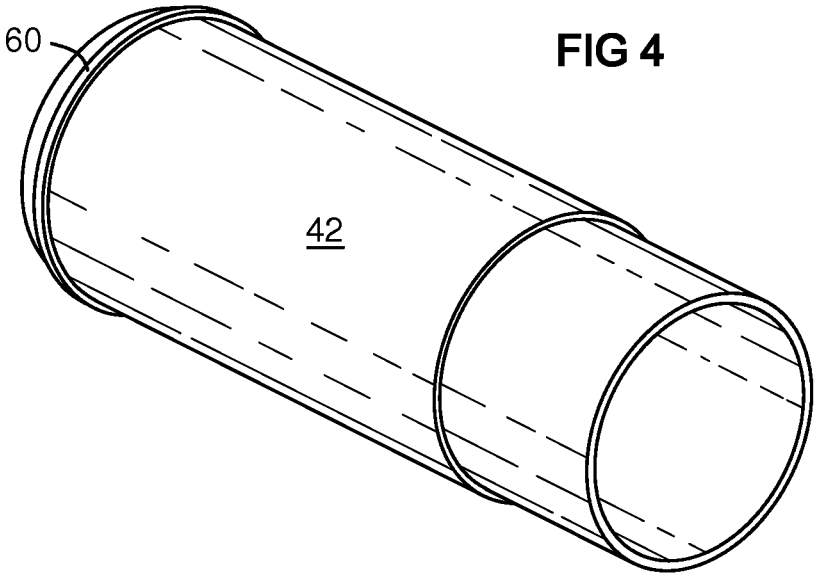
FIG. 4 is a perspective view of an exemplary outer pre-mix tube with an upstream flange in accordance with aspects of the invention.
Figure 5:
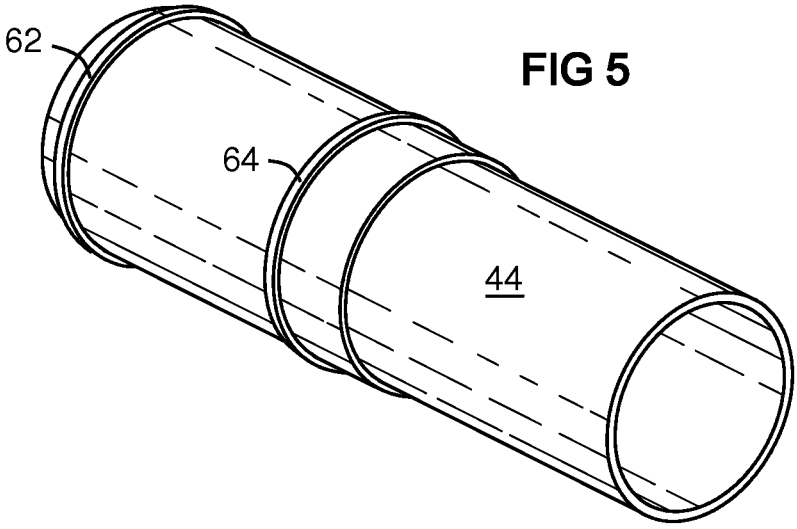
FIG. 5 is a perspective view of an exemplary central pre-mix tube with an upstream flange and an intermediate flange in accordance with aspects of the invention.

FIG. 4 is a perspective view of an exemplary outer pre-mix tube 42 with an upstream alignment flange 60. FIG. 5 is a perspective view of an exemplary central pre-mix tube 44 with an upstream alignment flange 62 and an intermediate alignment flange 64.

Figure 6:
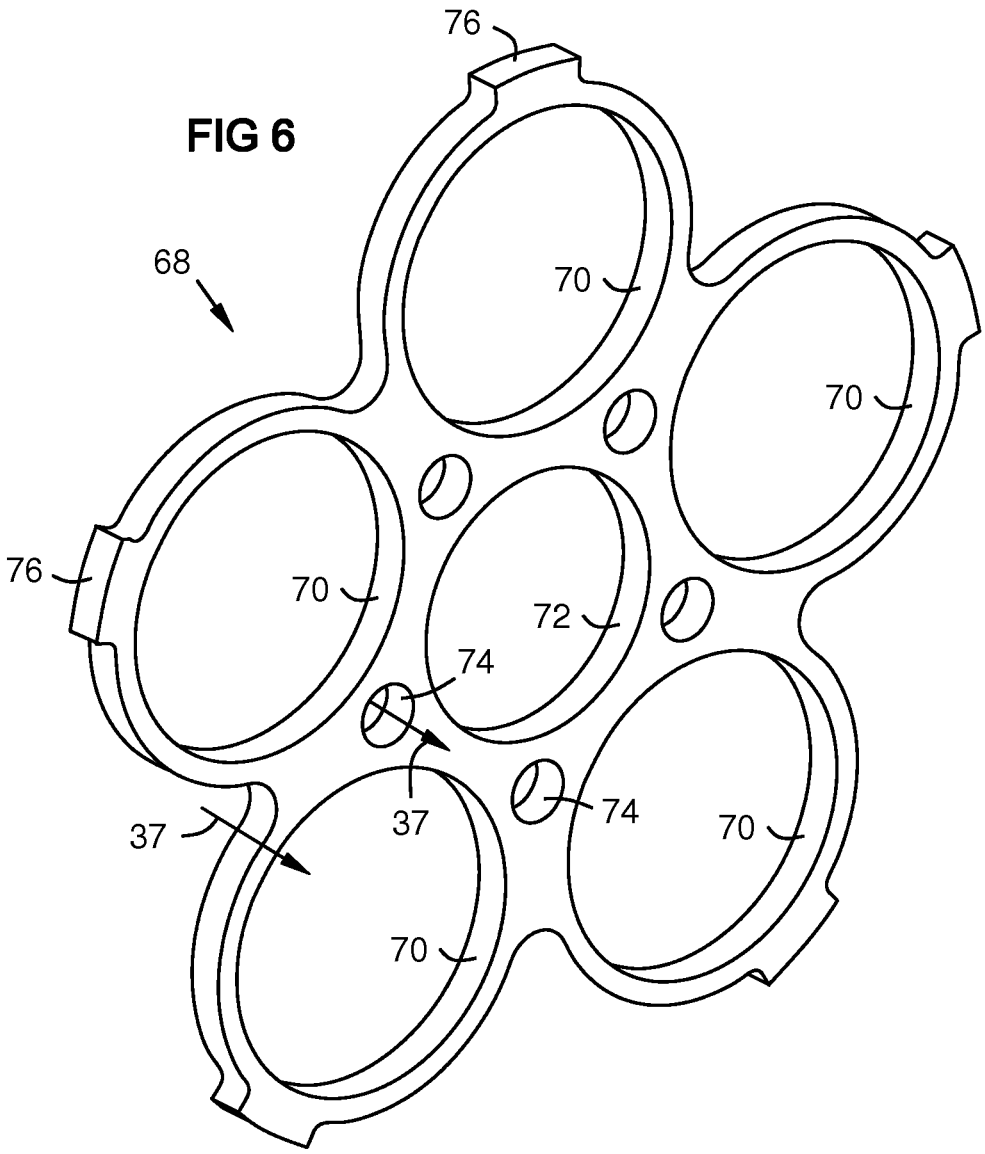
FIG. 6 is a perspective view of an exemplary intermediate structural frame in accordance with aspects of the invention.

FIG. 6 is a perspective view of an exemplary intermediate structural frame 68 that is suitable for use with embodiments of the present invention. Structural frame 68 may be formed with a respective stabilization ring 70 for each of the outer pre-mix tubes 42 and a central stabilization ring 72 for the central pre-mix tube 44. Structural frame 68 may have holes 74 for weight reduction and passage of the coolant 37. Perimeter tabs 76 may be formed on an outer edge of one or more of the respective stabilization rings 70 for attaching the structural frame 68 to the inner surface of the inner support ring 48.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A combustor cap assembly of a gas turbine engine, comprising:

a primary feed plate attached across an upstream end of a support ring;

a fuel/air premix tube within the support ring, the pre-mix tube comprising an upstream flange that aligns and seats the fuel/air pre-mix tube against the primary feed plate, the fuel/air premix tube further comprising an intermediate flange which is fixed on an outer surface of the fuel/air premix tube at an intermediate position along the fuel/air premix tube; and an intermediate structural frame at an intermediate location along the pre-mix tube having an opening through which the fuel/air premix tube passes, wherein the opening is sized such that the intermediate flange cannot pass through;

wherein the intermediate flange contacts the intermediate structural frame and the intermediate structural frame restricts longitudinal movement of the fuel/air premix tube relative to the support ring.

2. The combustor cap assembly of claim 1, wherein:

the upstream flange extends around an outer surface of the fuel/air pre-mix tube;

the primary feed place comprises a first hole that admits the fuel/air pre-mix tube up to the upstream flange, and does not admit the upstream flange;

the fuel/air premix tube is disposed in the first hole; and the upstream flange is seated against the primary feed plate.

3. The combustor cap assembly of claim 2, wherein the fuel/air premix tube is welded to the primary feed plate around the first hole.

4. The combustor cap assembly of claim 2, wherein the fuel/air premix tube is welded to the intermediate structural frame around the opening.

5. The combustor cap assembly of claim 2, wherein the fuel/air premix tube is welded to the primary feed plate and to the intermediate structural frame around the first hole and the opening of the intermediate structural frame.

6. The combustor cap assembly of claim 5, wherein the fuel/air premix tube is a central pre-mix tube, and further comprising a plurality of outer pre-mix tubes disposed in a circular array around the central premix tube, each of the outer premix tubes comprising an upstream flange seated against the primary feed plate around a respective hole in the primary, wherein the support ring surround the outer pre-mix tubes, and the primary feed plate and the intermediate structural frame are attached along respective perimeters thereof to the support ring.

7. The combustor cap assembly of claim 6, wherein the intermediate structural frame further comprises a plurality of stabilization rings each receiving a respective one of the outer pre-mix tubes in a slidable engagement that limits relative lateral movement of the outer pre-mix tubes while allowing differential thermal expansion there between.

8. The combustor cap assembly of claim 7, further comprising:

a coolant inlet hole formed in the support ring for receiving coolant into the assembly;

at least one hole formed in the intermediate structural frame for weight reduction and passage of the coolant along the assembly; and an effusion plate engaged with a downstream end of the central pre-mix tube and the outer pre-mix tubes, the effusion plate comprising perforations effective for effusion cooling by the coolant exiting from the assembly.

9. A combustor cap assembly of a gas turbine engine, comprising:

a fuel/air premix tube;

an upstream flange around an outer surface of the premix tube;

a primary feed plate comprising a first hole that admits the fuel/air premix tube up to the upstream flange, and does not admit the upstream flange;

wherein the fuel/air premix tube is disposed in the first hole, and the upstream flange is seated against the primary feed plate;

an intermediate flange which is fixed on an outer surface of the fuel/air pre-mix tube at an intermediate position along a length of the fuel/air premix tube; and an intermediate structural frame comprising a second hole that admits the fuel/air premix tube up to the intermediate flange, and sized not to admit the intermediate flange;

wherein the fuel/air premix tube is disposed in the second hole, and the intermediate flange is seated against the intermediate structural frame;

wherein the primary feed plate and the intermediate structural frame are attached along respective perimeters thereof to a surrounding support ring, and the intermediate structural frame restricts longitudinal movement of the fuel/air premix tube relative to the support ring.

10. The combustor cap assembly of claim 9, wherein the pre-mix tube is welded to the primary feed plate around the first hole, and the pre-mix tube is welded to the intermediate structural frame around the second hole.

11. The combustor cap assembly of claim 9, wherein the pre-mix tube is welded to the primary feed plate around the first hole, and the pre-mix tube is disposed in a slidable engagement with the intermediate structural frame around the second hole.

12. The combustor cap assembly of claim 9, further comprising:

a coolant inlet hole formed in the support ring for admitting coolant;

at least one coolant hole formed in the intermediate structural frame for the passage of the coolant along the outer surface of the pre-mix tube.

13. A combustor cap assembly of a gas turbine engine comprising:

a central fuel/air premix tube and a circular array of outer fuel/air premix tubes disposed around the central pre-mix tube;

a support ring that surrounds the circular array of outer fuel/air premix tubes;

each of the central and outer fuel/air premix tubes comprising a respective upstream flange that aligns the respective fuel/air premix tubes with a primary feed plate attached to an upstream end of the support ring;

the central fuel/air pre-mix tube further comprising an intermediate flange which is fixed on an outer surface of the central fuel/air premix tube at an intermediate position along the fuel/air premix tube;

an intermediate support frame having a central opening through which the central fuel/air premix tubes passes, the central opening sized such that the intermediate flange cannot pass through, the intermediate flange contacting the intermediate support frame, and the intermediate support frame restricts longitudinal movement of the fuel/air premix tube relative to the support ring;

the primary feed plate comprising respective holes aligned with each of the respective central and outer fuel/air premix tubes for the passage of fluid there through; and each of the respective upstream flanges fixedly attached to the primary feed plate.

14. The combustor cap assembly of claim 13, wherein each of the upstream flanges is welded to the primary feed plate, and the intermediate flange is welded to the intermediate support frame.

15. The combustor cap assembly of claim 13, wherein the intermediate support frame comprises a plurality of stabilization rings each receiving a respective one of the outer fuel/air pre-mix tubes in a slidable engagement that limits relative lateral movement of the outer fuel/air pre-mix tubes while allowing differential thermal expansion there between.

16. The combustor cap assembly of claim 13:

wherein the intermediate support frame is attached to the support ring intermediate a length of the support ring; and wherein the intermediate support frame further comprises a plurality of outer holes each admitting a respective one of the outer fuel/air pre-mix tubes for lateral support thereof.

* * * * *